US006744457B2

(12) United States Patent
Seino et al.

(10) Patent No.: US 6,744,457 B2
(45) Date of Patent: Jun. 1, 2004

(54) THERMAL PRINTER

(75) Inventors: Takumi Seino, Chiba (JP); Seiichi Jimbo, Chiba (JP)

(73) Assignee: SII P & S Inc., Chiba (JP)

( * ) Notice: Subject to any disclaimer, the term of this patent is extended or adjusted under 35 U.S.C. 154(b) by 0 days.

(21) Appl. No.: 10/358,822

(22) Filed: Feb. 5, 2003

(65) Prior Publication Data

US 2003/0160857 A1 Aug. 28, 2003

(30) Foreign Application Priority Data

Feb. 22, 2002 (JP) ..... 2002-046569

(51) Int. Cl.[7] ..... B41I 11/00; B41J 2/325
(52) U.S. Cl. ..... 347/220; 347/222
(58) Field of Search ..... 347/171, 220, 347/222, 215, 197; 400/120.16, 690.4, 691, 693, 55, 613; 101/288, 228

(56) References Cited

U.S. PATENT DOCUMENTS 5,579,043 A * 11/1996 Patry ..... 347/222
6,004,053 A * 12/1999 Petteruti et al. ..... 400/693
6,011,571 A * 1/2000 Lardant et al. ..... 347/197
6,118,469 A * 9/2000 Hosomi ..... 347/222
6,491,459 B2 * 12/2002 Hosomi ..... 400/613

* cited by examiner

*Primary Examiner*—K. Feggins
(74) *Attorney, Agent, or Firm*—Adams & Wilks

(57) ABSTRACT

A thermal printer has a printing head, a platen for urging the paper against the printing head, a bearing for rotatably holding the platen shaft and having an engagement portion for holding the platen in place, a movable platen frame for moving the bearing between a first position to perform printing and a second position at which the bearing is spaced further apart from the printing head than in the first position, and a frame having an engagement groove engageable with the engagement portion of the bearing when the platen is moved into the first position to perform painting, the engagement groove having a shape corresponding to the engagement portion of the bearing. The engagement portion of the bearing has a symmetrical, non-circular shape with respect to a central axis of the platen shaft, so that idle rotation of the platen bearing is prevented.

16 Claims, 8 Drawing Sheets

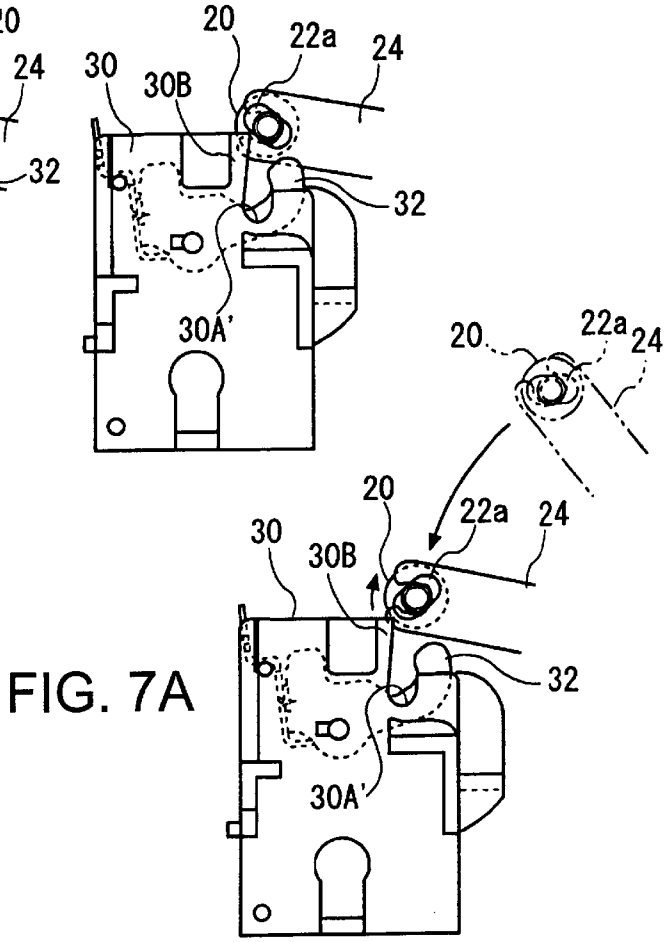
FIG. 7A
FIG. 7B
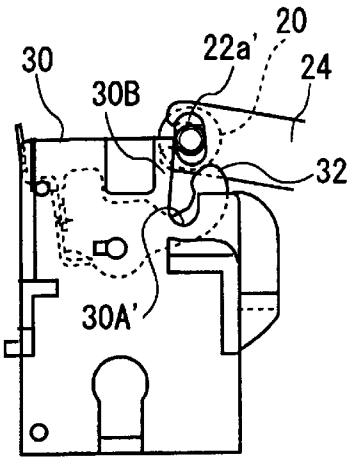
FIG. 7C
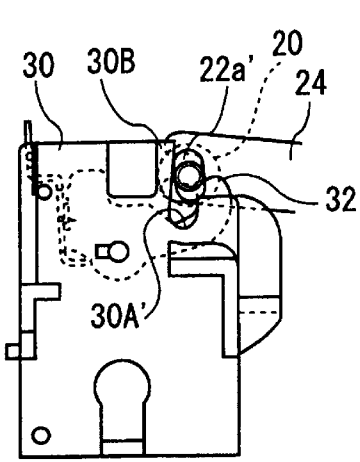
FIG. 7D
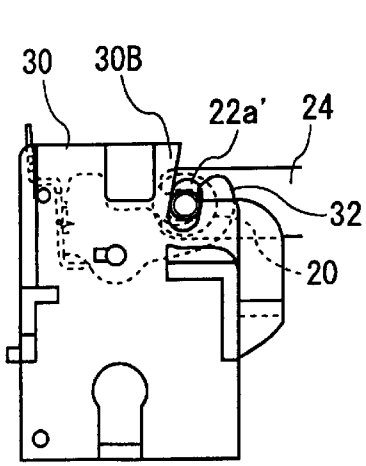
FIG. 7E

THERMAL PRINTER

BACKGROUND OF THE INVENTION

1. Field of the Invention

The present invention relates to a thermal printer in which paper is clamped between a printing head and a platen to perform printing and in which a platen release mechanism for separating the platen from the printing head is provided.

2. Description of the Related Art

A thermal printer in which paper is clamped between a printing head and a platen to perform printing is sometimes used as a printer unit mounted on a cash register for printing onto a receipt.

In such a thermal printer, in some cases, there is provided a platen release mechanism for attaching/detaching the platen to/from the printing head, whereby the platen is separated from the printing head during replacement of paper. When new paper is laid on the printing head, the platen is returned to its original position to thereby set the paper.

FIG. 8 is a side elevational view illustrating a conventional platen release mechanism.

In the platen release mechanism, right and left bearings 82 for rotatably holding a shaft 80*a* of a platen 80 are held by a platen frame 84 with back and forth play, and this platen frame 84 is rotated to separate the platen 80 from a printing head 90 or fix the platen to the normal operational position where it is brought into contact with the printing head 90. Under the condition that the platen 80 is fixed in the normal operational position, the above-described bearings 82 are engaged with engagement grooves 86A formed in the body frame 86 of the thermal printer and the bearings 82 are fixed under the condition that the bearings are hooked and retained at lock arms 92.

However, in the conventional platen release mechanism, since portions engaging with the engagement grooves 86A in the bearings 82 of the platen 80 are in cylindrical shapes, in the case where frictional force is reduced due to, for example, adhesion of oily components to these portions, there is a possibility that the bearings 82 are rotated under the condition that the bearings are fitted with the engagement grooves 86A in accordance with the rotational drive of the platen 80. When the platen bearings 82 are rotated, the portions of the engagement grooves 86A and the bearings 82 are worn out to cause reduction in durability and the rotary center of the platen 80 is displaced to adversely affect the feed amount of paper to generate degradation in printing quality and printing faults.

SUMMARY OF THE INVENTION

An object of this invention is to prevent the idle rotation of platen bearings while keeping the detaching and attaching operationability of a platen in a thermal printer provided with a platen release mechanism for separating the platen away from a printing head.

In order to achieve the above-mentioned object, according to the present invention, there is provided a thermal printer for printing on paper clamped between a printing head and a platen, comprising a bearing for rotatably holding a shaft of the platen, a movable platen frame for holding the bearing, an engagement groove that is provided on a body frame and is engageable with an engagement portion of the bearing in a state in which the platen is moved to a normal operation position, and a lock arm for retaining a part of the bearing and for fixing the bearing in engagement with the engagement groove, with the thermal printer being provided with a platen release mechanism for allowing the platen to be attachable to and detachable from the normal operation position, in which the engagement portion of the bearing is formed into a point-symmetrical shape with respect to a celtral axis of a platen shaft and a non-circular shape (for example, rhombus or ellipsoid) as viewed from the axial direction of the platen shaft and the engagement groove is formed into a shape corresponding to the engagement portion of the bearing.

Also, the engagement portion of the bearing is formed into a line-symmetrical shape with respect to a straight line passing through a center of the platen shaft and a non-circular shape (for example, a regular triangular shape or a regular pentagonal shape) as viewed from axial direction of the platen shaft and the engagement groove is formed into a shape corresponding to the engagement portion of the bearing.

According to such structure, since the bearings are not rotated on the engagement grooves, it is possible to prevent the degradation in durability due to wearing of the bearings and the frame, and to further stabilize the rotation of the platen to thereby make it possible to enhance the printing quality. Furthermore, in the conventional structure, in order to prevent rotation of the bearings, it is necessary to increase the thickness of the frame or to increase the pressing force between the bearings and the frame to thereby increase the frictional resistance between the bearings and the engagement grooves as much as possible. However, according to the present invention, since such countermeasures are not necessary, it is possible to reduce the thickness of the frame for miniaturization and reduction in cost. Also, since the pressing force between the bearing and the frame may be reduced, it is possible to use material that has a relatively low rigidity for the frame or other members, to thereby make it possible to reduce the cost.

Also, the shape of the bearings is formed to be point-symmetrical with respect to the center of the platen shaft or to be line-symmetrical with respect to the straight line passing through the center, so that even if the bearings are held to the platen frame under the condition that a play is given and in a rotatable state, it is easy to engage the bearings and the engagement grooves in the normal orientation.

It is preferable that the engagement portion of the bearing is formed into a longitudinal shape as viewed from the axial direction of the platen shaft. With such a structure, when the bearing is engaged with the engagement groove, a rotational angle of the bearing is likely to be determined so that it is possible to avoid the case where the bearing is forcibly engaged with the engagement groove under the condition that the bearing and the engagement groove are not normally engaged with each other.

It is further preferable that a size of an introduction port of the engagement groove is set so as to be smaller than a longer width of the engagement portion of the bearing. With such a structure, it is possible to completely avoid the engagement in an incorrect orientation between the bearing and the engagement groove.

It is further preferable that a contact member brought into contact with one side of the engagement portion for correcting the orientation of the engagement portion of the bearing is provided on a forward side of the engagement groove on a path along which the engagement portion of the bearing is moved.

With such a means, even if the orientation of the bearing is one in which the bearing is not engaged with the engagement groove, the above-described contact member is brought into contact with the bearing when the bearing is caused to be close to the engagement groove, so that the bearing is automatically corrected to the an orientation in which the bearing is engaged with the engagement groove. Accordingly, it is possible to always engage the bearing and the engagement groove in a normal direction.

BRIEF DESCRIPTION OF THE DRAWINGS

For a better understanding of the present invention, reference is made to a detailed description as follows to be read in conjunction with the accompanying drawings, in which:

FIGS. 7A–7B are illustrations of an example of a process in which the platen bearing is engaged with the engagement groove according to the second embodiment;

DETAILED DESCRIPTION OF THE PREFERED EMBODIMENT

Hereinafter, embodiments of the present invention will be described with reference to the attached drawings.

[First Embodiment]

Figure 1:
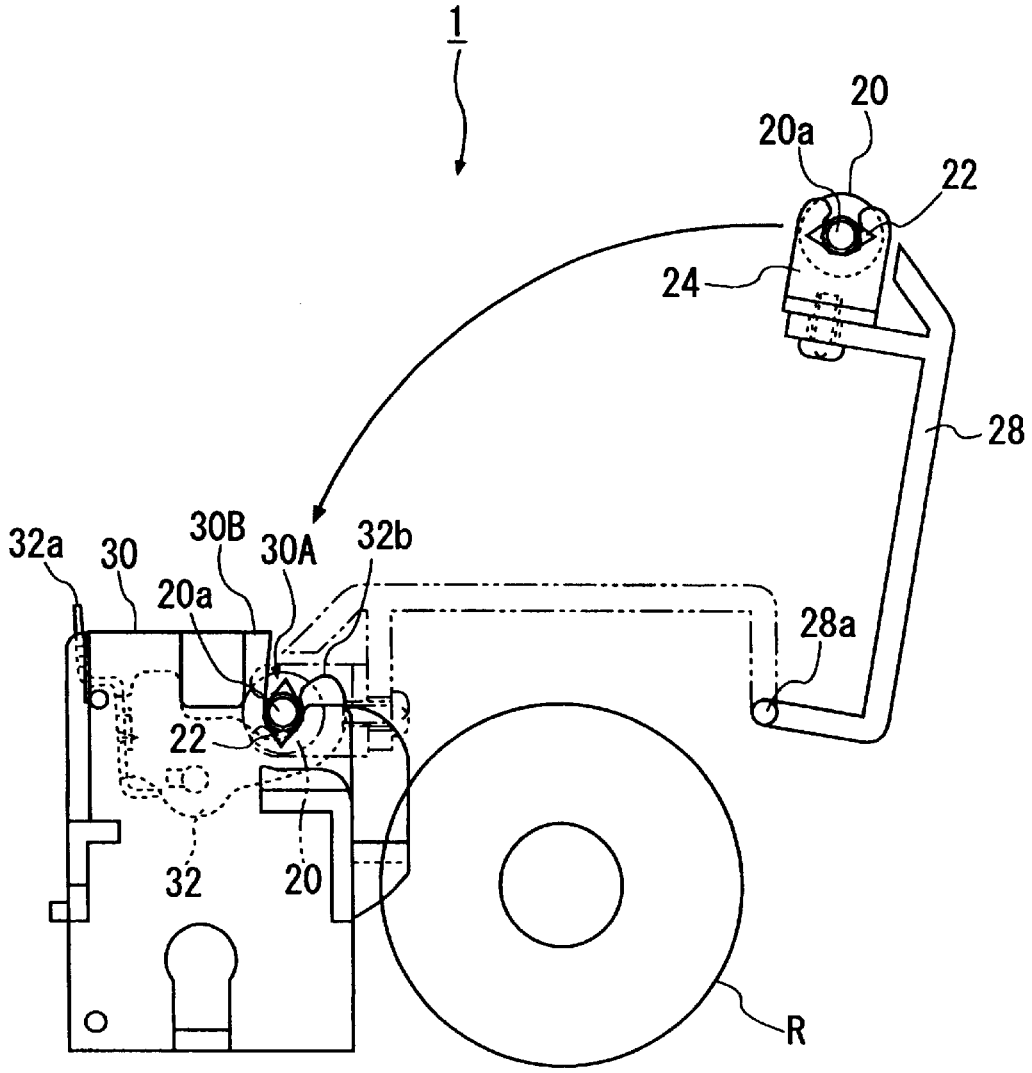
FIG. 1 is a side elevational view of an overall structure of a thermal printer in accordance with a first embodiment of the present invention.
Figure 2:
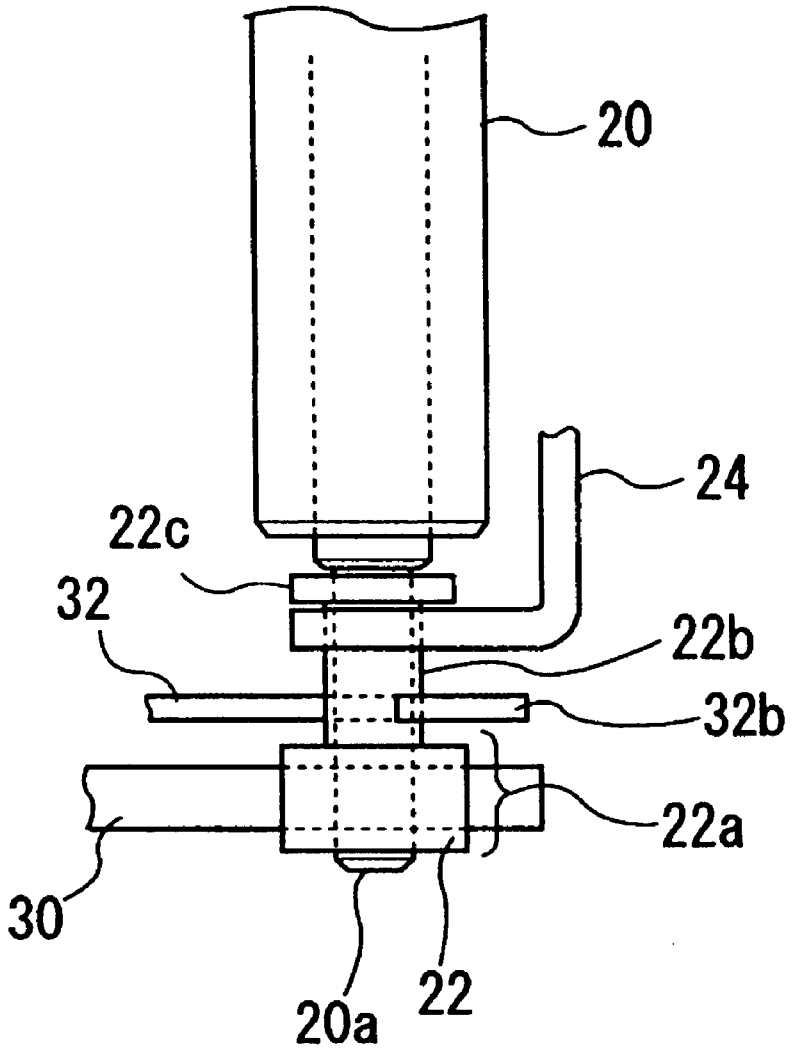
FIG. 2 is a plan view showing a periphery of the platen bearing in the thermal printer of FIG. 1.

FIG. 1 is a side elevational view of an overall structure of a thermal printer in accordance with a first embodiment of the present invention. FIG. 2 is a plan view showing a periphery of a platen bearing under the condition in which the platen bearing is engaged.

A thermal printer 1 according to this first embodiment is, for example, a printer unit mounted on a cash register or the like for performing printing of a receipt, and performs printing while clamping a roll of paper R between a platen 20 and a printing head (not shown) and, at the same time, is structured so that the platen 20 is rotated to feed the roll of paper R in a paper feed direction. Furthermore, this thermal printer 1 has a platen release mechanism for separating the platen 20 away from the printing head when the roll of paper R is replaced and so on.

The platen release mechanism is provided with a platen frame 24 for holding the platen 20 attached to a roll cover 28 for covering a receiving portion of the roll of paper R, and is adapted to rotate and open the roll cover 28 about a rotary shaft 28*a* and, at the same time, separate the platen 20 away from the printing head. A lock arm 32 for fixing the platen 20 under the condition that the platen 20 is in pressing contact with the printing head during the normal operation is provided on the side of a printer body, and a lever 32*a* of this lock arm 32 is depressed to release the retaining of the lock arm 32 so that the platen may be released from the normal operational position.

More specifically, a shaft 20*a* of the platen 20 is rotatably held to right and left bearings 22 and the bearings 22 are held to the platen frame 24 such that the bearings 22 have a slight amount of play and are rotatable so that the platen is held to the platen frame 24.

As shown in FIG. 2, the platen bearing 22 includes a central portion 22*b* that has a cylindrical shape having a small diameter, a flange 22*c* for preventing pull-out and having a large diameter provided on the side close to the platen 20, and a portion overlapping with a body frame 30 serving as an engagement portion 22 having a predetermined shape and being engaged with an engagement groove 30A of the frame. The central portion 22*b*, the flange 22*c* and the engagement portion 22*a* are formed integrally with each other. Then, the central portion 22*b* is fitted in a bifurcated holder portion of the platen frame 24 so that the platen bearing 22 is rotatably held to the platen frame 24 and the flange 22*c* is brought into contact with the platen frame 24 so that the platen bearing is not so much moved in the right and left directions (in the axial direction of the platen shaft 20*a*). On another side of the platen 20, in the same manner, the bearing 22 is held so that the platen 20 or the bearing 22 is not pulled out in the right and left directions.

A retainer claw 32*b* at an end of the lock arm 32 is adapted to be slightly hooked to the central portion 22*b* of the platen bearing 22 to retain the bearing 22. The lock arm 32 is kept under the condition that it is biased at one end by a spring or the like fixed to the printing head, and the platen 20 and the printing head are depressed against each other under the condition that the bearing 22 is retained.

Figure 3:
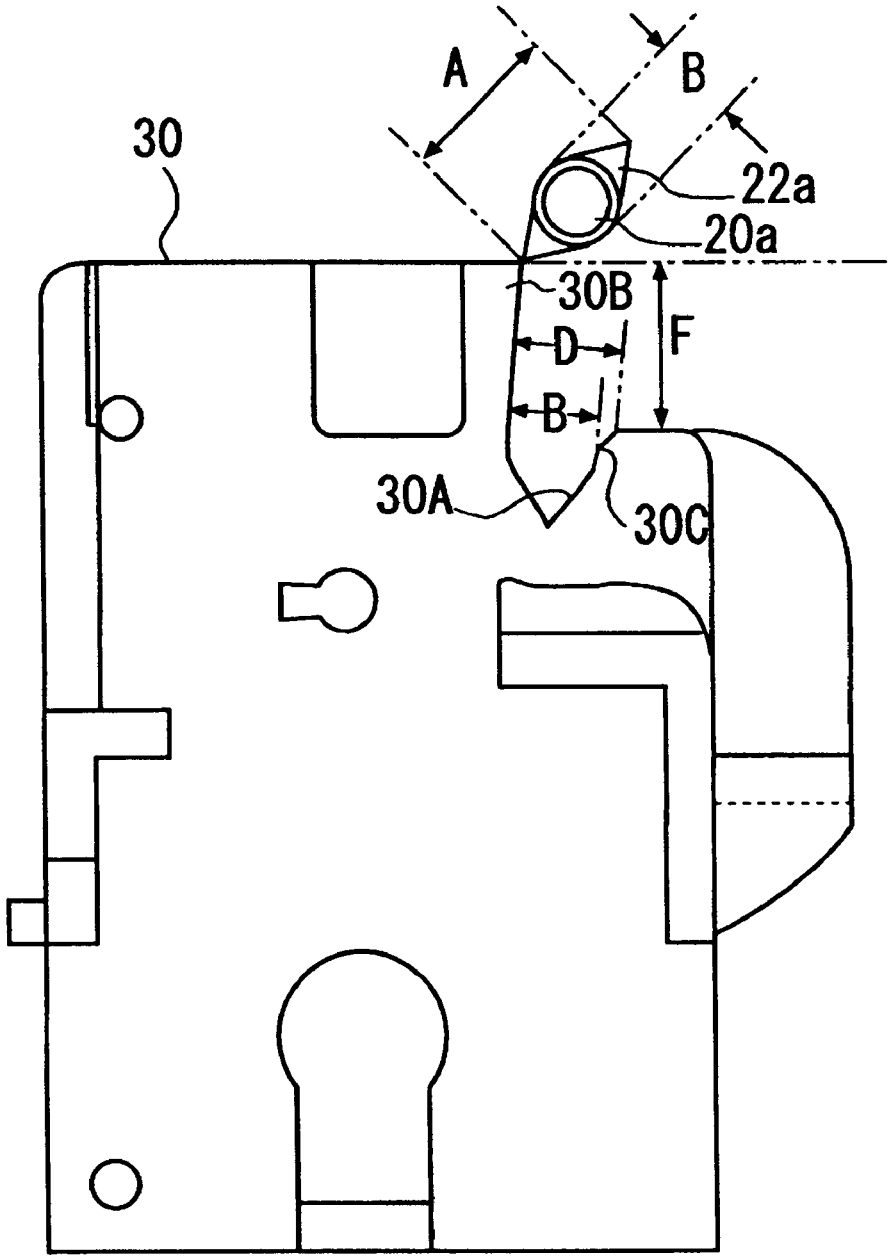
FIG. 3 is a side elevational view illustrating shapes of the platen bearing and an engagement groove according to the first embodiment.
Figure 4A:
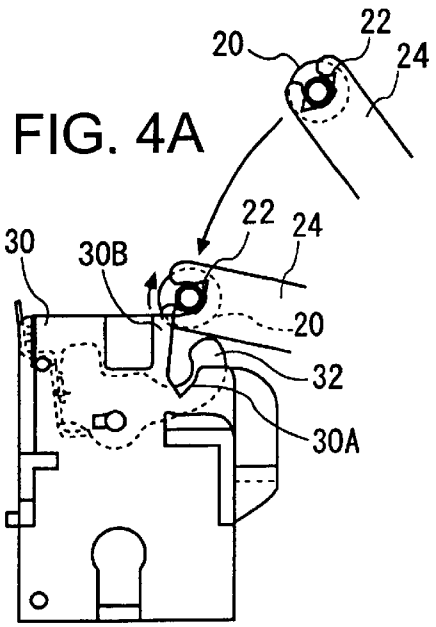
FIGS. 4A–4D are illustrations of a first example of a process in which the bearing of the platen according to the first embodiment is engaged with the engagement groove.
Figure 4B:
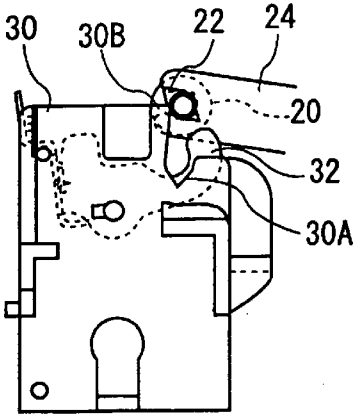
Figure 4C:
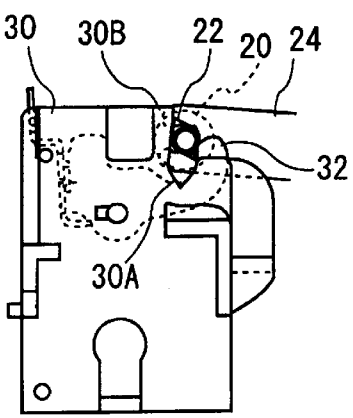
Figure 4D:
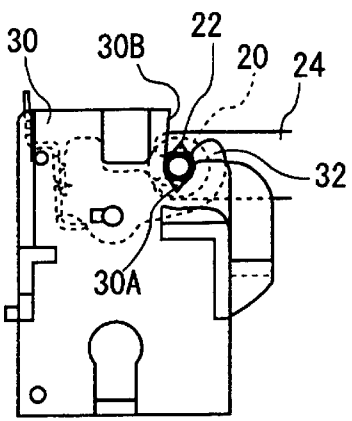
Figure 4C:
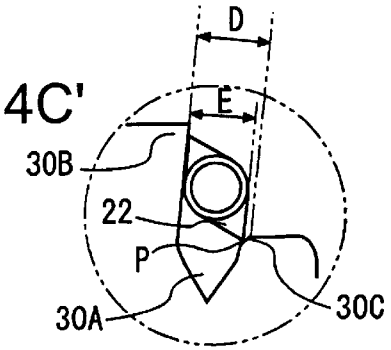
Figure 5A:
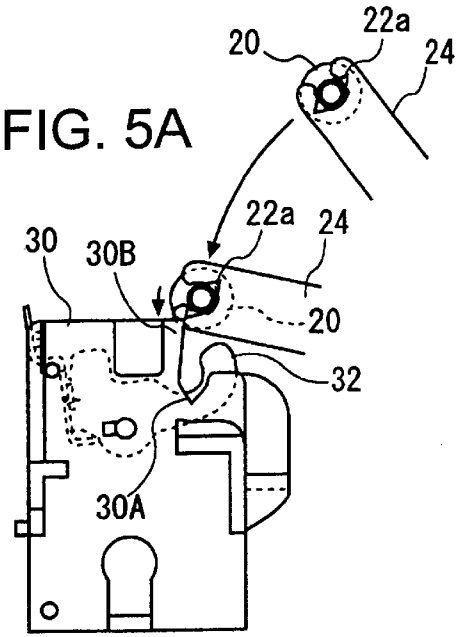
FIGS. 5A–5D are illustrations of a second example of the same process.
Figure 5B:
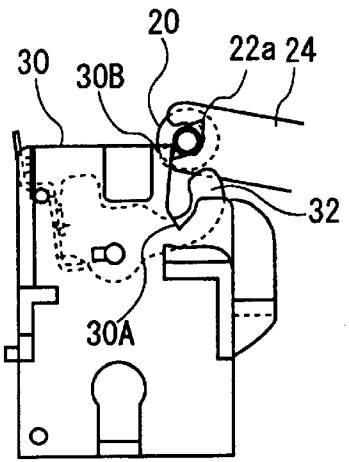
Figure 5C:
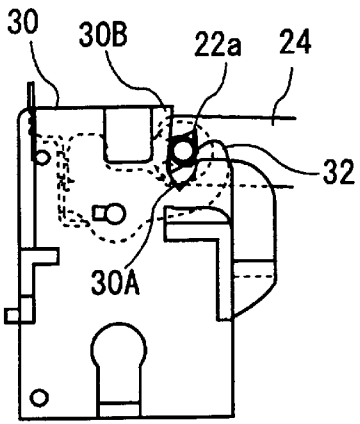
Figure 5D:
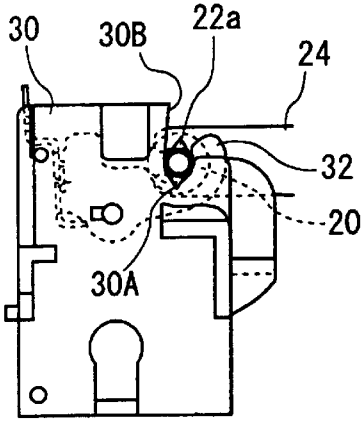

FIG. 3 is a side elevational view showing the respective shapes of the engagement portion 22*a* of the platen bearing 22 and the engagement groove 30A formed in the frame 30.

An engagement portion 22*a* of the platen bearing 22 is formed substantially into a rhombus shape as viewed from an axial direction of the platen shaft 20*a*. More specifically, two angles having a smaller distance between apexes out of sets of the opposite two angles of the rhombus are made arcuate. This shape is a point-symmetrical shape about the center of the platen shaft 22*a* and is adapted to overlap the original shape when the bearing 22 is rotated through 180 degrees.

On the other hand, in the engagement groove 30A formed in the frame 30, a groove formed substantially in the same shape as that of a portion of one angle (an angle having a larger apex interval of the opposite two angles) of the above-described engagement portion 22*a* is formed so as to be engaged with the engagement portion. Furthermore, a guide wall 30B serving as a contact member that is brought into contact with one side of the bearing 22 when the bearing 22 enters the engagement groove 30A for correcting the bearing 22 to be in engagement in the normal direction (longitudinal direction), is formed in a left shoulder portion of the engagement groove 30A. On the other hand, nothing is provided in a right shoulder portion of the engagement groove 30A in a portion overlapping the path along which the bearing 22 is moved so that the rotation of the bearing 22 is not prevented and the right shoulder portion is formed to be lowered by a step F than the guide wall 30B.

A cutaway 30C for expanding an introduction port for allowing the bearing 22 to easily enter the engagement groove 30A when the bearing 22 enters with its apex slanted most rightward is provided in the introduction port (also see FIG. 4(*c*')) of the engagement groove 30A. Namely, a size D of the introduction port of the engagement groove 30A is set to be smaller than a longitudinal width A of the engagement portion 22*a* of the bearing 22, also greater than a lateral width B and somewhat greater than a distance E between sides facing each other.

FIG. 4 show illustrations of first examples (a) to (d) of a process until the platen bearing 22 is engaged with the engagement groove 30A. FIG. 4(*c*') is an enlarged view in which a part of the bearing 22 and the engagement groove 30A in a state of FIG. 4(*c*) is enlarged. FIG. 5 show illustrations of second examples (a) to (d) of the process until the platen bearing 22 is engaged with the engagement groove 30A.

When the roll cover 28 is rotated to return the platen 20 to the normal operational position, since the orientation of the bearing 22 is not uniform, the bearing is brought into contact with the guide wall 30B depending upon its orientation and its orientation is corrected. For example, in the case where the bearing 22 is introduced so that one apex of the engagement portion 22*a* of the bearing 22 is brought into contact with a top surface side of the guide wall 30, as shown in FIGS. 4(*a*) and 4(*b*), the bearing 22 is rotated clockwise and introduced into the engagement groove 30A.

Furthermore, even if the bearing is introduced under the condition that a lower apex P is shifted to a rightmost position as shown in FIGS. 4(*c*) and 4(*c'*), when the apex P reaches the introduction port of the engagement groove 30A, it is brought into contact with the cutaway 30C and guided on the engagement groove 30A side. Then, under this condition, as shown in FIG. 4(*d*), the engagement portion 22*a* of the bearing 22 is introduced into the engagement groove 30A and fitted with the engagement groove 30A so that a portion of the central portion 22*b* of the bearing 22 is retained to the lock arm 32.

On the other hand, in the case where one apex of the engagement portion 22*a* of the bearing 22 is slidingly introduced along the right side surface of the guide wall 30, as shown in FIGS. 5(*a*) to 5(*d*), the bearing 22 is smoothly introduced into the engagement groove 30A under this condition. Namely, in the case where the bearing 22 is introduced at any orientation, it is possible to engage the engagement portion 22*a* of the bearing 22 and the engagement groove 30A with each other at a normal orientation.

[Second Embodiment]

In a thermal printer according to a second embodiment, shapes of the engagement portion of the bearing and the engagement groove formed in the frame are different from those of the first embodiment. In the second embodiment, the engagement portion of the bearing 22 is indicated by reference symbol 22*a*' and the engagement groove of the frame 30 is indicated by reference symbol 30A'.

Figure 6:
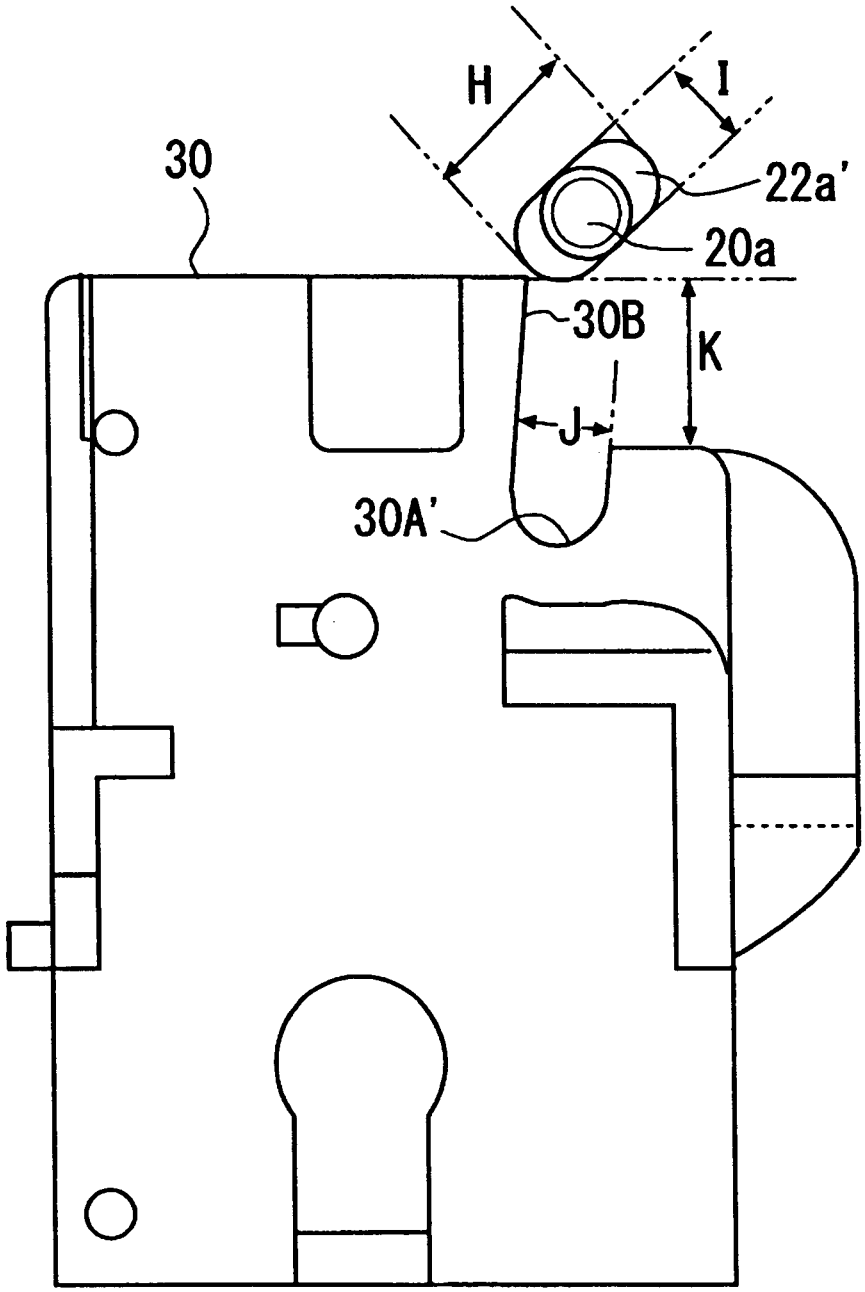
FIG. 6 is a side elevational view showing shapes of a platen bearing and an engagement groove of a thermal printer of a second embodiment of the present invention.

FIG. 6 shows a side elevational view showing the respective shapes of the engagement portion 22*a*' of the platen bearing 22 and the engagement groove 30A' formed in the frame 30 according to the second embodiment.

In the engagement portion 22*a*' of the platen bearing 22 according to this embodiment, each shorter side of a rectangular shape is formed into a semicircular shape as viewed from an axial direction of the platen shaft 20*a*. This shape is a point-symmetrical shape with respect to a center of the platen shaft 20*a* and overlapping the original shape when the bearing 22 is rotated through 180 degrees.

On the other hand, the engagement groove 30A' has substantially the same shape as that of a lower half of the above-described engagement portion 22*a*' so as to be engaged therewith in the case where the engagement portion 22*a*' is arranged longitudinally. Namely, a size J of the introduction port of the engagement groove 30A' is smaller than a longitudinal width H of the engagement portion 22*a* and is set to be somewhat larger than a lateral width I and the arcuate portion of the above-described engagement portion 22*a* enters and is fitted into the bottom portion of the engagement groove 30A'.

Also, in the same manner as in the first embodiment, a guide wall 30B is formed in a left shoulder portion of the engagement groove 30A' and a right shoulder portion of the engagement groove 30A' is formed to be lower by a step K.

FIG. 7 illustrate a process in which the platen bearing is engaged with the engagement groove according to the second embodiment.

Also, in this second embodiment, when the roll cover 28 is rotated and the platen 20 is returned back to the normal operational position, the orientation of the bearing 22 is not always kept constant. Accordingly, the bearing is brought into contact with the guide wall 30B and corrected in its orientation depending upon its orientation.

For example, in the case where, as shown in FIG. 7(*a*), the arcuate portion of the engagement portion 22*a*' of the bearing 22 is introduced while being brought into contact with a corner portion of the guide wall 30, as shown in FIGS. 7(*c*) to 7(*e*), the engagement portion 22*a*' is rotated clockwise and corrected to the longitudinal orientation and is introduced into the introduction port of the engagement groove 30A'.

Furthermore, even if, as shown in FIG. 7(*b*), the arc on the lower side of the engagement portion 22*a*' is slanted to a rightmost position and introduced, the arcuate portion is brought into contact with the introduction portion of the engagement groove 30A' and guided to the side of the engagement groove 30A'. Then, as shown in FIG. 7(*e*), the engagement portion 22*a*' enters the interior of the engagement groove 30A' under this condition and engages with the engagement groove 30A' and the portion of the central portion 22*b* of the bearing 22 is retained at the lock arm 32.

Note that, in the case where the hook is strong at the introduction portion of the engagement groove 30A', a cutaway is provided at a corner of the right shoulder portion of the engagement groove 30A' and the size of the introduction port is somewhat expanded to thereby facilitate the introduction without any hook.

Also, in the case where the arcuate portion of the engagement portion 22*a*' of the bearing 22 enters so as to slide along a side surface of the guide wall 30, the bearing is smoothly introduced and fitted into the engagement groove 30A under this condition. Namely, in the case where the engagement portion 22*a*' of the bearing 22 is introduced at any orientation, it is possible to engage the engagement portion 22*a* and the engagement groove 30A with each other at a normal orientation.

As described above, in the thermal printer according to the above-described first and second embodiments, it is possible to readily perform the replacement of rolls of paper or the set of the paper by the platen release mechanism for separating the platen 20 together with the bearing 22 away from the printing head, and at the same time, when the platen 20 is returned back to the normal operational position, the engagement portion 22*a* (22*a*') of the bearing 22 is engaged without any rotation to the engagement groove 30A (30A') of the frame 30. Accordingly, it is possible to solve the conventional problem that the bearing would be worn out through the rotation with respect to the frame and the printing quality would be advertently affected.

Figure 8:
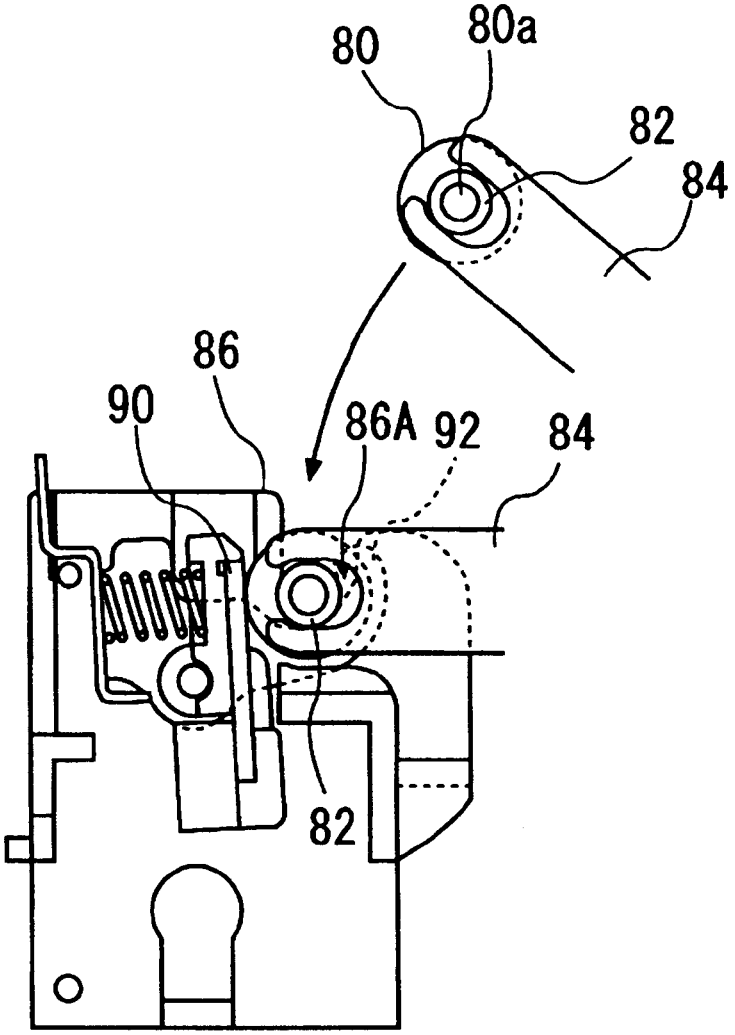
FIG. 8 PRIOR ART
FIG. 8 is a side elevational view showing a periphery of a platen engagement portion of a conventional thermal printer provided with a platen release mechanism.

Also, in the prior art, as a countermeasure, it is necessary to increase the thickness of the frame to increase the frictional resistance in order to prevent the rotation of the bearing or to strongly retain the bearing 82 by the lock arm 92 (see FIG. 8). However, according to the embodiments of the present invention, since such countermeasures are not necessary, it is possible to reduce the thickness of the frame 30 for miniaturization and reduction of the cost, and also to reduce the retaining force of the lock arm 32 and the pressing force between the platen 20 and the printing head to reduce the mechanical strength of each member or the drive force of the drive motor of the platen 20 to thereby make it possible to reduce the cost required for the overall structure.

Furthermore, since the shape of the engagement portion 22*a*, 22*a*' of the bearing 22 is set as a point-symmetrical shape with respect to the center of the platen shaft 20*a* in order to cause no problem even if the bearing 22 is rotated through 180 degrees and set therein, even if the bearing 22 is held to the platen frame 24 so that it is rotatable and has a play, it is possible to smoothly engage the bearing 22 with the engagement groove 30A, 30A' in a normal orientation.

Furthermore, since the engagement portion 22*a*, 22*a*' is formed into a longitudinal shape, it is possible to completely avoid the retaining in a wrong orientation. Also, the engagement groove 30A, 30A' is also formed into a longitudinal shape and the size of the introduction port is smaller than the longer width of the engagement portion 22*a*, 22*a*' of the bearing 22, so that it is possible to more completely avoid the retaining in a wrong direction of the engagement portion 22*a*, 22*a*' of the bearing 22.

Furthermore, when the bearing 22 is caused to be close to the engagement groove 30A, the guide wall 30B is brought into contact with the engagement portion 22*a*, 22*a*' of the bearing 22 to correct the bearing 22 in a normal orientation. Accordingly, it is possible to smoothly introduce the bearing 22 into the engagement groove 30A, 30A'.

Note that, the present invention is not limited to the foregoing embodiments and various changes are possible. For example, it is possible to form the engagement portion of the bearing into a perfect rhombus or ellipsoid. Also, even if the shape is a line-symmetrical shape with respect to a straight line passing through an axial center such as a regular triangle or a regular pentagon, it is possible to ensure the effect that the bearing is not rotated.

Also, in the embodiments, the engagement groove is formed into a shape following the part of the engagement portion of the bearing and the engagement portion of the bearing is fitted with almost no gap. However, if the engagement portion of the bearing has a shape in which it is positioned and engaged, any shape may be taken.

Also, it is possible to smoothly engage the bearing with the engagement groove by changing suitably the shape of the contact member (guide wall) and the shape of the introduction port of the engagement groove in conformity with the shape or the movement path of the bearing.

As described above, according to the present invention, since the bearings are not rotated on the engagement grooves, it is possible to prevent the degradation in durability due to the wear of the bearings and the frame, and further to stabilize the rotation of the platen to thereby make it possible to enhance the printing quality.

Also, even if the thickness of the frame is decreased or the pressing force between the bearing and the frame or the pressing force between the platen and the printing head is decreased, the bearing is not rotated. It is thus possible to reduce the cost due to the miniaturization of the overall structure or the decrease in necessary mechanical strength of each member. Also, it is possible to reduce the rotational load of the platen to reduce the cost of the drive motor of the platen.

Also, even if the engagement portion of the bearing is rotated through half-turn or through a predetermined angle, the shape in which the bearing may engage with the engagement groove is similarly taken (rhombus, ellipsoid, or regular triangle or regular pentagon), it is possible to allow the bearing to be easily engaged with the engagement groove even if the bearing is held rotatably. Thus, it is possible to increase the degree of freedom of the platen release mechanism that moves while holding the bearing.

Also, the engagement portion of the bearing is formed into a longitudinal shape and the engagement groove is also formed into a longitudinal shape so that the engagement between the bearing and the engagement groove in a wrong orientation may be avoided. Furthermore, the contact member for correcting the orientation of the engagement portion while contacting from one side with the engagement portion of the bearing is provided in the previous stage of the engagement groove so that the bearing may always be introduced into the engagement groove smoothly and be engaged therewith normally.

What is claimed is:

1. A thermal printer comprising: a printing head for printing on paper; a platen having a shaft opposed to the printing head by a small gap for urging the paper against the printing head; a bearing for rotatably holding the platen shaft and having an engagement portion for holding the platen in place, the engagement portion having a symmetrical, non-circular shape with respect to a central axis of the platen shaft; a movable platen frame for selectively moving the bearing between a first position at which the platen is closely spaced from the printing head to perform printing and a second position at which the platen is spaced further apart from the printing head than in the first position; a frame having an engagement groove engageable with the engagement portion of the bearing when the platen is moved into the first position to perform printing, the engagement groove having a shape corresponding to the engagement portion of the bearing; and a lock arm for retaining a part of the bearing and fixing the bearing in engagement with the engagement groove, the lock arm having a platen release mechanism for allowing the platen to be locked and unlocked from the first position.

2. A thermal printer according to claim 1; wherein the engagement portion of the bearing has a point-symmetrical shape with respect to the central axis of the platen shaft.

3. A thermal printer according to claim 1; wherein the engagement portion of the bearing has a line-symmetrical shape with respect to the central axis of the platen shaft.

4. A thermal printer according to claim 1; wherein the engagement portion of the bearing has a longitudinal shape as viewed from an axial direction of the platen shaft.

5. A thermal printer according to claim 4; wherein the engagement groove has an introduction port having a smaller opening size than a portion of the engagement portion of the bearing having the longest width.

6. A thermal printer according to claim 1; wherein the engagement groove has an introduction port having a smaller opening size than a portion of the engagement portion of the bearing having the longest width.

7. A thermal printer according to claim 1; wherein the engagement portion of the bearing has a rhombus or ellipsoid shape as viewed from an axial direction of the platen shaft.

8. A thermal printer according to 1; wherein the engagement groove defines a path along which the engagement portion of the bearing is movable, and the engagement groove has a contact member on a forward side of the path that comes into contact with one side of the engagement portion for correcting an orientation of the engagement portion so that the engagement portion is smoothly movable along the path.

9. A printer comprising: a printing head for printing on paper; a platen having a shaft opposed to the printing head by a small gap for urging the paper against the printing head; a bearing for rotatably holding the platen shaft and having an engagement portion for holding the platen in place, the engagement portion having a symmetrical, non-circular shape with respect to a central axis of the platen shaft; a movable platen frame for selectively moving the bearing between a first position at which the platen is closely spaced from the printing head to perform printing and a second position at which the bearing is spaced further apart from the printing head than in the first position; and a frame having an engagement groove engageable with the engagement portion of the bearing when the platen is moved into the first position to perform printing, the engagement groove having a shape corresponding to the engagement portion of the bearing.

10. A printer according to claim 9; wherein the engagement portion of the bearing has a point-symmetrical shape with respect to the central axis of the platen shaft.

11. A printer according to claim 9; wherein the engagement portion of the bearing has a line-symmetrical shape with respect to the central axis of the platen shaft.

12. A printer according to claim 9; wherein the engagement portion of the bearing has a longitudinal shape as viewed from an axial direction of the platen shaft.

13. A printer according to claim 9; wherein the engagement groove has an introduction port having a smaller opening size than a portion of the engagement portion of the bearing having the longest width.

14. A printer according to claim 9; wherein the engagement portion of the bearing has a rhombus or ellipsoid shape as viewed from an axial direction of the platen shaft.

15. A thermal printer according to claim 14; wherein the engagement groove has an introduction port having a smaller opening size than a portion of the engagement portion of the bearing having the longest width.

16. A thermal printer according to 9; wherein the engagement groove defines a path along which the engagement portion of the bearing is movable, and the engagement groove has a contact member on a forward side of the path that comes into contact with one side of the engagement portion for correcting an orientation of the engagement portion so that the engagement portion is smoothly movable along the path.

* * * * *